United States Patent [19]

Hejlik

[11] Patent Number: 4,623,067

[45] Date of Patent: Nov. 18, 1986

[54] COMPACT FOLDABLE CRANE

[75] Inventor: Larry J. Hejlik, Garner, Iowa

[73] Assignee: Iowa Mold Tooling Co., Inc., Garner, Iowa

[21] Appl. No.: 677,875

[22] Filed: Dec. 4, 1984

[51] Int. Cl.[4] ..... B66C 23/42

[52] U.S. Cl. ..... 212/188; 212/187

[58] Field of Search ..... 212/183, 185, 187, 188, 212/230, 258, 264; 52/117; 414/550, 547

[56] References Cited

U.S. PATENT DOCUMENTS

| | | | |
|---|---|---|---|
| 3,819,059 | 6/1974 | Mantel | 212/188 |
| 3,870,162 | 3/1975 | Nakajo | 212/188 |
| 4,150,754 | 4/1979 | Schmitt | 212/188 |

FOREIGN PATENT DOCUMENTS

| | | | |
|---|---|---|---|
| 2535948 | 7/1976 | Fed. Rep. of Germany | 212/188 |
| 1367982 | 12/1964 | France | 212/183 |
| 163756 | 5/1980 | Netherlands | 212/188 |

*Primary Examiner*—Trygve M. Blix
*Assistant Examiner*—Thomas J. Brahan
*Attorney, Agent, or Firm*—Wood, Dalton, Phillips, Mason & Rowe

[57] ABSTRACT

A compact foldable crane for mounting on a truck or the like and of the type including a mast, an inner boom and an outer boom. The mast is made of two sections, a mounting section and an upright section and the two are pivotally interconnected. The upright section is made relatively long in relation to the mounting section and may be lowered on the latter to achieve vertical compactness when the crane is in a stored position. The upright section may also be raised to an upright position to maximize the crane reach when the crane is in an operative position.

8 Claims, 4 Drawing Figures

COMPACT FOLDABLE CRANE

FIELD OF THE INVENTION

This invention relates to a foldable crane, and more specifically, to a crane that may be folded into a very compact configuration and which is ideally suited for mounting on a vehicle such as a truck.

BACKGROUND OF THE INVENTION

Truck mounted cranes have seen increasing popularity over the last several years. Such cranes are employed for a variety of uses. In the most familiar use, they are employed for loading or unloading the contents of the truck bed. An auxiliary use may include the handling or manipulation of some object in addition to the usual loading and unloading function. An example of the latter resides in servicing the tires of large wheeled vehicles as, for example, agricultural tractors, off the road vehicles, etc.

In any event, one highly desirable requisite of such cranes is that they be foldable to a compact storage and travel position. In short, when the crane is not being used and the vehicle is travelling from one point to another, the crane should occupy minimum space on the truck. Firstly, this will allow the load of the truck, in terms of space, to be maximized. Secondly, it will allow the truck to readily move between points without concern for obstructions along its route as, for example, low bridges, tunnels, low hanging vegetation or wires, etc.

As a consequence of these desires, a typical truck mounted crane is provided with an upright mast which most frequently will be pivoted to the bed of the truck near one end thereof for rotation about a vertical axis. The upper end of the mast will typically pivotally mount a boom assembly consisting of an inner boom and an outer boom pivoted thereto. In many cases, the outer boom will be made up of telescoping elements so that its length may be selectively varied as required.

For storage purposes, the outer boom will typically be retracted to its shortest length and folded under the inner boom. In some cases, the remote end of the outer boom may be caused to pass through a space in the mast or, alternatively, to one side of the mast such that in silhouette, a figure "4" configuration is assumed.

In many instances, this storage configuration is totally satisfactory for the purpose. However, it does have some limitations which may be critical in some cases.

For example, the vertical compactness of such a crane is limited by the height of the mast. The taller the mast, the less the vertical compactness.

When vertical compactness is to be achieved by shortening the mast, the elevational or vertical reach of the crane is accordingly reduced.

In some instances, the mast may be canted at an angle of 40–50° to the vertical to thereby reduce its vertical height. Canting will typically be in the direction away from the boom with the result that both vertical and horizontal reach are sacrificed.

The present invention is directed to overcoming one or more of the above problems.

SUMMARY OF THE INVENTION

It is the principal object of the invention to provide a new and improved compact, foldable crane, particularly suited for mounting on a truck or the like. More specifically, it is an object of the invention to provide such a crane wherein extreme compactness, both vertically and horizontally, is achieved without sacrificing either vertical or horizontal reach.

An exemplary embodiment of the invention achieves the foregoing object in a crane structure including inner and outer elongated booms which are pivotally connected to each other at adjacent ends. A first reciprocal motor interconnects the booms at locations spaced from their pivotal interconnection and is operative to pivot the outer boom relative to the inner boom between a first position wherein the outer boom acts as an extension of the inner boom and a second position wherein the outer boom is folded under the inner boom.

The boom construction is mounted on a mast comprised of a relatively short mounting section and a relatively long upright section. The upright section is pivotably mounted at one end to the mounting section for movement about a horizontal axis between an upright position and a lowered position. Means pivotally interconnect the inner boom, at its end remote from the outer boom, to the upright section at the end thereof opposite the mounting section such that the inner boom extends from the upright section in a direction opposite the direction of movement of the upright section when moving from the upright position toward the lowered position. A second reciprocal motor is located oppositely of the booms and interconnects the mast sections for moving the upright section between the upright and lowered positions.

As a consequence, for storage purposes, the upright section of the mast may be lowered to achieve vertical compactness while, when in use as a crane, such section may be raised to the upright position so as to maximize both vertical and horizontal reach.

In a preferred embodiment, both the upright section and the mounting section of the mast are each defined by two parallel plates or beams spaced sufficiently to permit the outer boom to pass therebetween to a storage position.

The invention contemplates that the upright section and the mounting section of the mast, adjacent their pivotal interconnection have interengaging stop means for limiting movement of the upright section past the upright position under the influence of a load on the boom or the second reciprocal motor.

This feature of the invention causes the pivotal interconnection between the mast sections and the stop means to coact to rigidify the mast when it is in the upright position against pivoting moments created by the weight of the booms and/or a load thereon, without loading the second reciprocal motor in tension.

In a highly preferred embodiment, the stop means comprise an arcuate notch or surface on one of the mast sections and a pin aligned therewith and carried by the other of the mast sections. In a highly preferred embodiment, the notched surface and the pin are located oppositely of the second motor about the pivotal interconnection between the mast sections.

Other objects and advantages will become apparent from the following specification taken in connection with the accompanying drawings.

DESCRIPTION OF THE PREFERRED EMBODIMENT

Figure 1:
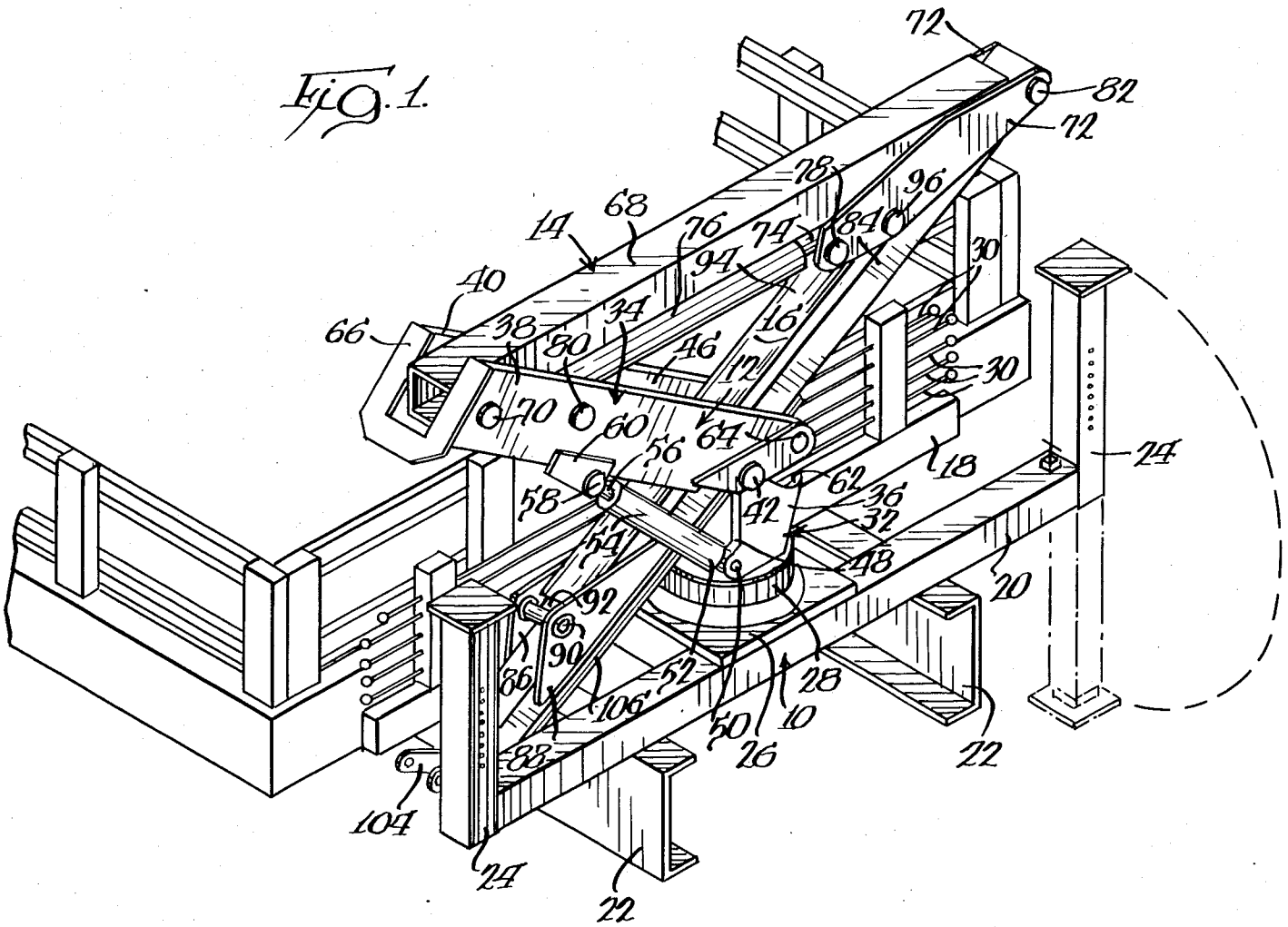
FIG. 1 is a perspective view of a crane made according to the invention and mounted on the bed of a vehicle, the vehicle bed being shown somewhat fragmentarily.

An exemplary embodiment of a compact foldable crane made according to the invention is illustrated in the drawings in the context of being mounted on a vehicle, specifically a truck. However, it is to be understood that the crane can be employed with efficacy in a variety of other settings including mounting on other vehicles as, for example, barges. It may also be employed in non-vehicular applications as well.

With reference to FIG. 1, the crane is seen to be made up of four main parts. A first is a base, generally designated 10. The second is a mast, generally designated 12 which is mounted on the base 10. A third is an inner boom, generally designated 14, which is connected to the mast 12 at its end opposite the base 10. A fourth component is an outer boom, generally designated 16, which is pivoted to the inner boom 14 so as to act as an extension of the latter.

In a vehicular application, the base 10 may be made up of two spaced, parallel beams 18 and 20 which are arranged transversely across the longitudinal frame members 22 of a vehicle. The beam 20, at its ends, will typically support conventional outrigger structures 24 which may be pivoted from the solid line position illustrated in FIG. 1 to the dotted line position when the crane is to be placed in use. Frequently, the outriggers 24 will be hydraulically activated as is well known to stabilize the vehicle frame against tipping when the crane is loaded.

Centrally of the beams 18 and 20, the base 10 includes a base plate 26 which is narrow in relation to the width of the vehicle and which mounts a turret 28 of conventional construction. The mast 12 is in turn mounted on the turret 28, with the latter providing for pivotal mounting of the former about a vertical axis as is well known. In the usual case, the turret 28 will include a hydraulic motor for pivoting the mast 12 about the base plate 26.

The beam 18 may mount a series of control rods 30 which extend to both sides of the vehicle frame 22. The control rods 30 control valves in a conventional hydraulic circuit for activating and controlling the crane. By reason of the extension of the control rods 30 to both sides of the vehicle, the crane may be operated from either side of such vehicle.

The mast 12 is formed of two sections. The first is a mounting section, generally designated 32, and the second is an upright section, generally designated 34. Both are formed of two spaced, parallel plates or beams. In particular, the mounting section 32 is formed of two plates 36 (only one of which is shown) while the upright section is formed of two plates 38 and 40.

At their lower ends, the plates 36 are fixed to the uppermost portion of the turret 28 as by welding or bolts or the like. At their upper ends, the plates 36 mount pivot pins 42 (only one of which is shown). The pivot pins 42 pivotally mount the lower ends of respective ones of the plates 38 and 40 making up the upright section 34 to the mounting section 32. It is to be noted that the pins 42 do not traverse the space 46 that exists between the plates 38 and 40.

One of the plates 36, on a side 48 thereof, adjacent the turret 28, mounts a pivot pin 50 affixed to the cylinder end 52 of a hydraulic cylinder 54. The rod end 56 of the cylinder 54 is pivotally connected as by a pin 58 to a bracket 60 suitably secured to the plate 38 of the upright section 34. If desired, a similar cylinder can be mounted between the plate 36 that is not illustrated in FIG. 1 and the plate 40. By this construction, the cylinder 54 is mounted to one side of the space 46 existing between the plates forming the sections 32 and 34.

Oppositely of the motor 54, and in their upper surfaces, the plates 36 of the mounting section 32 each include an arcuate, upwardly opening notch 62 which forms part of a stop means. Stationary pins 64 carried by the plates 38 and 40 respectively may abut the mounting section 32 within the notches 62 to limit movement of the upright section 34 about the pivot pins 42 in the clockwise direction as viewed in FIG. 1 for purposes to be seen. Again, it should be noted that the pins 64 do not extend into the space 46 between the plates 38 or 40 or otherwise obstruct the space between the plates forming the sections 32 and 34.

At their ends remote from the pivot pins 42, the plates or beams 38 and 40 are interconnected by a U-shaped collar 66 to provide rigidity.

The inner boom 14 is made up of an elongated tube or box beam structure 68. At one end, the tube 68 is pivotally mounted as by a pin 70 to the plates 38 and 40 adjacent the collar 66. The space between the legs of the U-shaped collar 66 allows the tube 68 to relatively freely pivot about the pivot axis provided by the pin 70.

At its opposite end, the tube 68 mounts an elongated clevis 72 defined by plates. The rod end 74 of a cylinder 76 is connected by a pivot pin 78 to the clevis 72. The cylinder end of the cylinder 76 is pivoted between the beams 38 and 40 by pivot pin 80 at a location somewhat spaced from the pivot pin 70.

Figure 4:
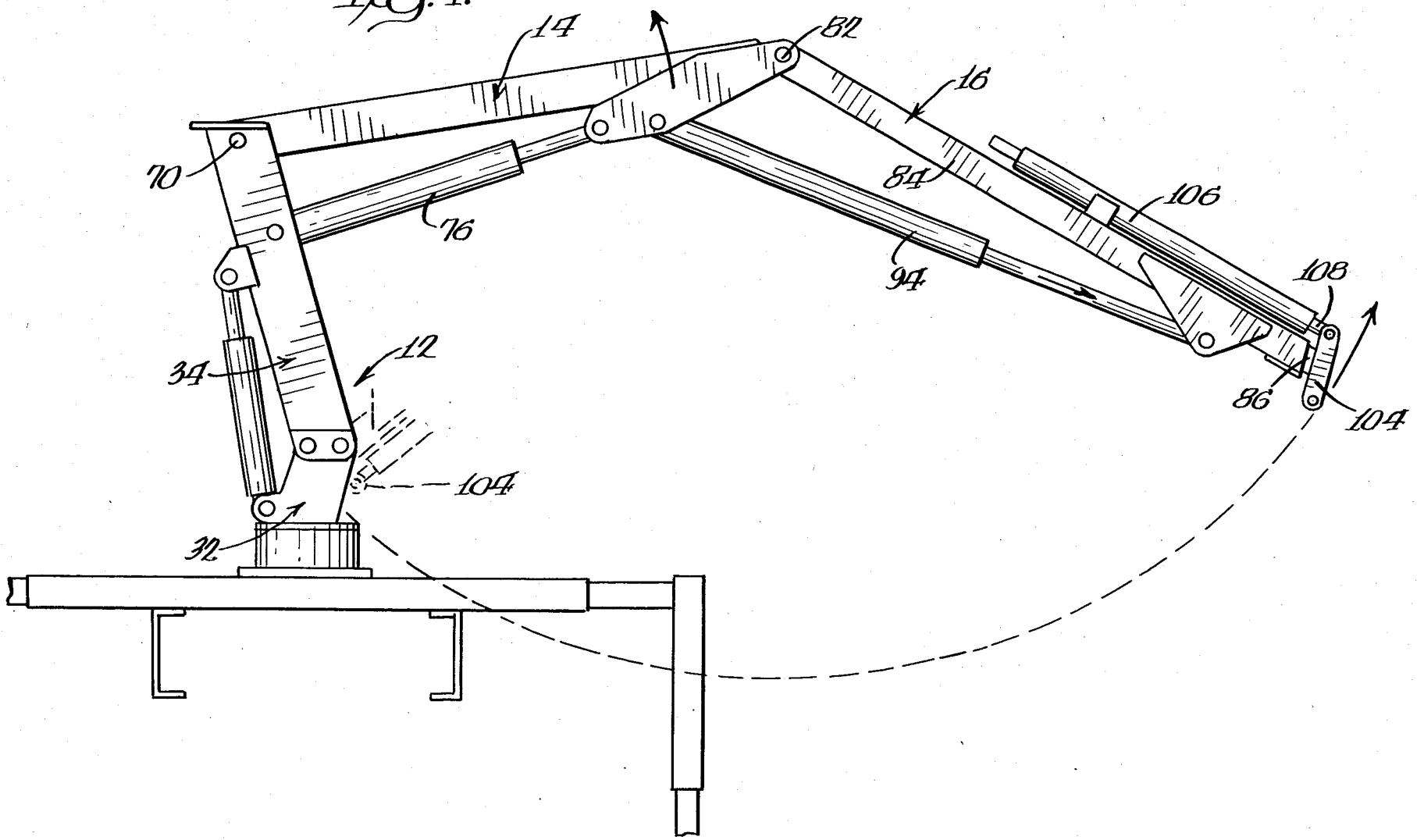
FIG. 4 illustrates a step subsequent to that illustrated in FIG. 3 in moving the crane from 8 stored position to a working position.

Oppositely of the pivot pin 78, the clevis 72 includes a pivot pin 82 by which the outer boom 16 is pivoted to the inner boom 14 at the end of the latter remote from the mast 12. The outer boom 16 will typically be formed of an elongated tube 84 which telescopingly receives a tube 86 (FIG. 4). When the crane is in operating position, the tube 86 may be extended by means to be described from the tube 84 to increase the overall reach of the crane.

Oppositely of the pivot pin 82, the tube 84 mounts a clevis 88 defined by plates. The clevis 88 receives a pivot pin 90 connected to the rod end 92 of a cylinder 94. The cylinder end of the cylinder 94 is pivoted to the clevis 72 by means of a pivot pin 96.

Figure 2:
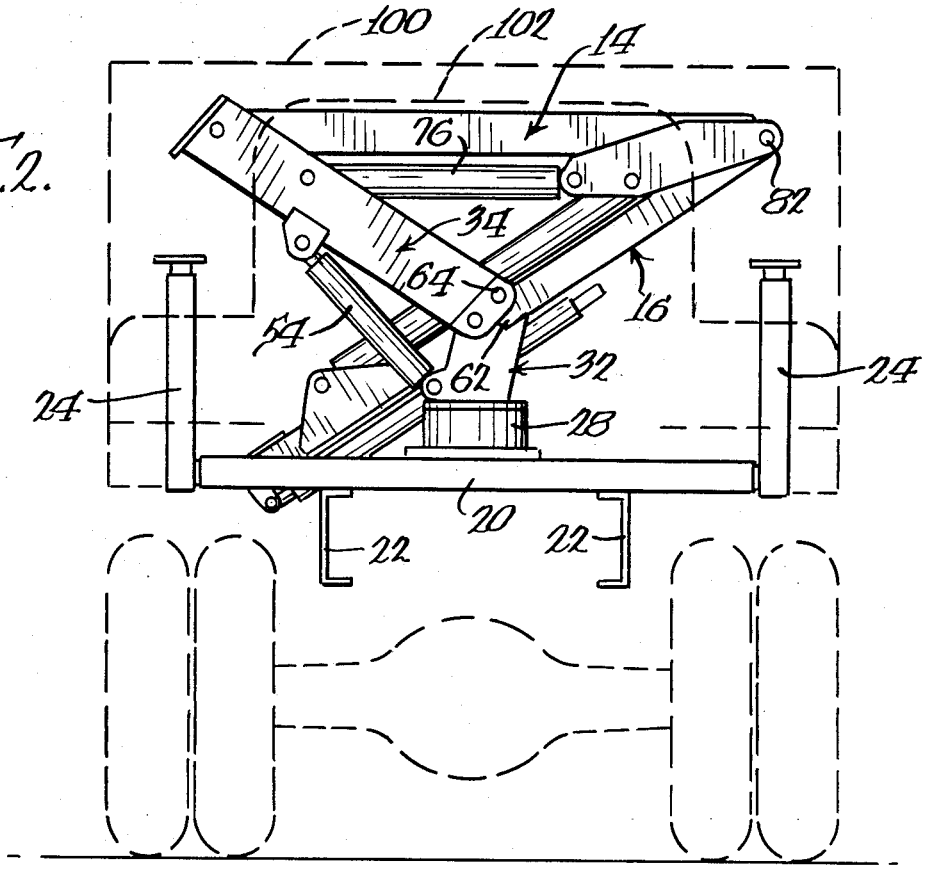
FIG. 2 is an elevational view of the crane in a stored position with portions of the vehicle shown in outline form.

As can be seen in FIGS. 1 and 2, the outer boom 16 is tucked under the inner boom 14 when in the storage position. Moreover, the outer boom 16 passes through the space 46 between the plates forming the mast 12 and extends to one side of the narrow base plate 26 and below the same, as well as between the beams 18 and 20.

FIG. 2 illustrates a crane in a stored position in relation to various truck components in a typical installation. For example, a relatively low profile body or the like on the truck bed is illustrated by a dotted line 100 while the profile of the cab of the vehicle is illustrated by a dotted line 102. It will be seen that vertically, the crane is within the profile of both and horizontally, the crane is within the envelope of the bed.

Figure 3:
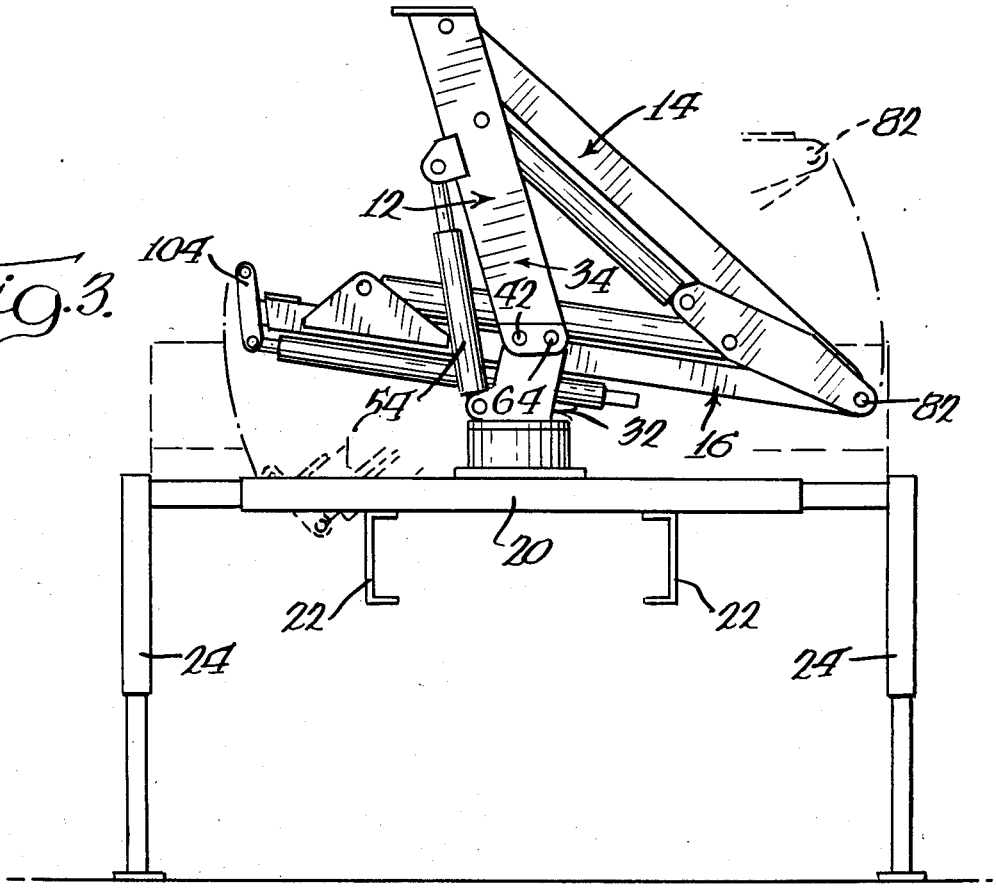
FIG. 3 illustrates a step in the manipulation of the crane in moving from the stored position of FIG. 2 toward a working position.

When it is desired to move the crane from the stored position illustrated in FIG. 2, the cylinder 54 is extended as illustrated in FIG. 3. This causes the upright section 34 to move from the lowered or storage position illustrated in FIG. 2 to the upright position illustrated in FIG. 3. It can be seen that the point of connection of the inner boom 14 to the outer boom 16, as represented by the pivot pin 82, moves from the dotted line position illustrated in FIG. 3 to the solid line position during this process.

It will also be observed that the stop pins 64 will have bottomed out in the notches 62 during such movement thus rigidifying the mast 12 in the direction of clockwise pivoting as viewed in FIG. 3. It will be appreciated that any forces tending to cause the upright section 34 to move past the upright position illustrated in FIG. 3 will be taken up solely in the stops defined by the notches 62 and pins 64 and the pivot 42 and thus will not be applied, in tension, to the cylinder 54 thereby avoiding damage thereto.

To further move the crane to the operative position, once the position illustrated in FIG. 3 is attained, the cylinder 76 is extended to the position illustrated in FIG. 4 thereby pivoting the inner boom 14 about the pivot pin 70 in a clockwise direction relative to the upright section 34 of the mast 12. This will result in the end 104 of the outer boom 16 being moved to the dotted line position in FIG. 4, that is, between the plates 36 forming the mounting section 32 of the mast 12.

At this point, the cylinder 94 may be extended to pivot the outer boom 16 about the pivot pin 82 to at least the solid line position 16.

To store the crane, the same sequence of steps is followed in reverse fashion.

To maximize the reach of the crane, as alluded to previously, the tube 86 may be extended from the tube 84 defining the outer boom 16. To this end, a hydraulic cylinder 106 is mounted on the outer boom 16 and includes a connection via a rod 108 to the end 104 of the outer boom which 16, in turn, is mounted on the tube 86.

Use of the crane is made in its normal fashion and, typically, the outriggers 24 will be disposed in an operative position at the beginning of the sequence of moving the crane components from the storage position as shown in FIG. 2.

As a consequence of the foregoing, the reach advantages achieved through the use of a substantially vertical boom of substantial length are maintained in a crane construction according to the invention. At the same time, vertical compactness when in the stored position is achieved by use of the unique mast construction wherein the upright section 34 can be moved to a lowered position relative to the mounting section.

By making the mounting section 32 as short vertically as possible and the upright section 34 as long as possible, maximum reach with maximum vertical compactness is achievable since, in the usual case, the design constraints imposed by the extended and retracted length of cylinders such as the cylinders 54 will preclude the upright section 34 from being lowered even closer to the horizontal position than that illustrated in FIG. 2.

I claim:

1. A compact, foldable crane for mounting on a truck or the like comprising:

inner and outer, elongated booms pivotally interconnected at adjacent ends;

a flat reciprocable motor interconnecting said booms at locations spaced from said pivotal interconnection and operative to pivot said outer boom relative to said inner boom between a first position wherein said outer boom acts as an extension of said inner boom and a second position wherein said outer boom is folded under said inner boom;

a mast comprised of a relatively short mounting section and a relatively long upright section pivotally mounted at one end to said mounting section for movement about a horizontal axis between an upright position and a lowered position, both of said upright section and said mounting section being defined by two parallel plates spaced sufficiently to permit said outer boom to pass through the space between said sections;

means pivotally connecting said inner boom, at its end remote from said outer boom, to said upright section at the end thereof opposite one end, such that said inner boom extends from said upright section in a direction opposite the direction of movement of said upright section when moving from said upright position toward said lowered position; and a second reciprocal motor located oppositely of said booms interconnecting said section for moving said upright section between said upright and lowered position.

2. The crane of claim 1 wherein said upright section and said mounting section, adjacent their pivotal connection, have interengaging stop means for limiting movement of said upright section past said upright position under the influence of a load on said boom or said second reciprocal motor.

3. The crane of claim 1 wherein said upright section and said mounting section, at a location spaced from their pivotal interconnection and independently of said second motor, include interengaging stop means for limiting movement of said upright section past said upright position, said pivotal interconnection and said stop means coacting to rigidify said mast, when in said upright position, against pivoting moments created by the weight of said booms and/or a load thereon.

4. The crane of claim 3 wherein said stop means comprise an arcuate notched surface on one of said sections and a pin aligned therewith carried by the other of said section.

5. The crane of claim 4 wherein said notched surface and said pin are located oppositely of said second motor about the pivotal interconnection between said sections.

6. A compact, foldable crane for mounting on a truck or the like comprising:

inner and outer, elongated booms pivotally interconnected at adjacent ends;

a first reciprocal motor interconnecting said booms at locations spaced from said pivotal interconnection and operative to pivot said outer boom relative to said inner boom between a first position wherein said outer boom acts as an extension of said inner boom and a second position wherein said outer boom is folded under said inner boom;

a mast of parallel beams or plates defining a space therebetween, said mast comprised of a relatively vertically short mounting section and a relatively vertically long upright section pivotally mounted at one end to said mounting section for movement about a horizontal axis between an upright position and a lowered position;

means pivotably connecting said inner boom, at its end remote from said outer boom to said upright section between said beams or plates and at the end thereof opposite said one end, such that said inner boom extends from said upright section in a direction opposite the direction of movement of said upright section when moving from said upright position toward said lowered position;

a second reciprocal motor located oppositely of said booms and interconnecting said sections for moving said upright section between said upright and lowered positions; and stop means at said upright section one end and oppositely of said second motor and engageable with said mounting section for limiting movement of said upright section past said upright position, said stop means being in non-interfering relation to the space between said beams or plates such that said outer boom may be directed through said space in a storage position.

7. The crane of claim 6 further including a base pivotally mounting said mounting section for rotation about a generally vertical axis, said base being sufficiently narrow that said outer boom, when in said storage position, may pass to one side and below the same.

8. The crane of claim 6 wherein said stop means comprise stationary pins on said beams or plates at said upright section one end, and aligned, upwardly opening notches on said vertically short mounting section, said pins and said notches being spaced from said horizontal axis.

* * * * *